US007511412B2

(12) United States Patent
Kim

(10) Patent No.: US 7,511,412 B2
(45) Date of Patent: Mar. 31, 2009

(54) ELECTRON EMISSION DEVICE WITH ENHANCED FOCUSING ELECTRODE STRUCTURE

(75) Inventor: You-Jong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 675 days.

(21) Appl. No.: 11/118,944

(22) Filed: Apr. 28, 2005

(65) Prior Publication Data

US 2005/0242705 A1 Nov. 3, 2005

(30) Foreign Application Priority Data

Apr. 29, 2004 (KR) ..... 10-2004-0029985

(51) Int. Cl.
*H01J 1/62* (2006.01)
*H01J 63/04* (2006.01)

(52) U.S. Cl. ..... 313/495; 313/309; 313/498; 313/497

(58) Field of Classification Search ..... 313/495–497, 313/306, 309–310, 293–304
See application file for complete search history.

(56) References Cited

U.S. PATENT DOCUMENTS 5,144,191 A * 9/1992 Jones et al. ..... 313/308
5,541,473 A * 7/1996 Duboc et al. ..... 313/422
5,654,607 A * 8/1997 Yamaguchi et al. ..... 313/495
6,190,223 B1 * 2/2001 Tjaden et al. ..... 445/24
6,354,897 B1 * 3/2002 Palevsky et al. ..... 445/24
6,509,687 B1 * 1/2003 Natarajan et al. ..... 313/495
6,511,545 B2 * 1/2003 Banno et al. ..... 118/688
2004/0027051 A1 * 2/2004 Moradi et al. ..... 313/495
2005/0082964 A1 * 4/2005 Konishi ..... 313/497
2005/0168130 A1 * 8/2005 Moradi et al. ..... 313/495
2006/0017363 A1 * 1/2006 Wei et al. ..... 313/311

* cited by examiner

*Primary Examiner*—Sikha Roy
*Assistant Examiner*—Tracie Y Green
(74) *Attorney, Agent, or Firm*—Christie, Parker & Hale, LLP

(57) ABSTRACT

An electron emission device comprises first and second substrates facing each other and separated from each other by a distance. First and second electrodes are positioned on the first substrate such that the first and second electrodes are insulated from each other. Electron emission regions are positioned on the first substrate and are electrically connected to at least one of the first and second electrodes. An insulating layer covers the first and second electrodes. A focusing electrode is positioned on the insulating layer. The focusing electrode includes openings to allow passage of electron beams. The focusing electrode comprises a first layer having a first thickness, a second layer beneath the first layer and a third layer surrounding the first layer. The second and third layers are electrically connected and have second and third thicknesses smaller than the first thickness.

24 Claims, 5 Drawing Sheets

ELECTRON EMISSION DEVICE WITH ENHANCED FOCUSING ELECTRODE STRUCTURE

CROSS REFERENCE TO RELATED APPLICATION

This application claims priority to and the benefit of Korean Patent Application No. 10-2004-0029985 filed on Apr. 29, 2004 in the Korean Intellectual Property Office, the entire content of which is incorporated herein by reference.

FIELD OF THE INVENTION

The present invention relates to an electron emission device, and in particular, to an electron emission device having an enhanced focusing electrode structure which intercepts the anode electric field and increases the electron beam focusing capacity.

BACKGROUND OF THE INVENTION

Generally, electron emission devices are classified into those using hot cathodes as the electron emission source, and those using cold cathodes as the electron emission source. There are several types of cold cathode electron emission devices, including a field emitter array (FEA) type, a metal-insulator-metal (MIM) type, a metal-insulator-semiconductor (MIS) type, and a surface conduction emitter (SCE) type.

The MIM-type and the MIS-type electron emission devices have electron emission regions with a metal/insulator/metal (MIM) structure and a metal/insulator/semiconductor (MIS) structure, respectively. When voltages are applied to the two metals or the metal and the semiconductor on either side of the insulator, electrons migrate from the high electric potential metal or semiconductor to the low electric potential metal where the electrons are accumulated and emitted.

The SCE-type electron emission device comprises a thin conductive film formed between first and second electrodes arranged facing each other on a substrate. High resistance electron emission regions or micro-crack electron emission regions are positioned on the thin conductive film. When voltages are applied to the first and second electrodes and an electric current is applied to the surface of the conductive film, electrons are emitted from the electron emission regions.

The FEA-type electron emission device uses electron emission regions made from materials having low work functions or high aspect ratios. When exposed to an electric field in a vacuum atmosphere, electrons are easily emitted from these electron emission regions. Electron emission regions having sharp front tip structures have been used. These electron emission regions mainly comprise molybdenum (Mo), silicon (Si), or a carbonaceous material such as carbon nanotube, graphite, or diamond-like carbon.

The above-identified electron emission devices commonly comprise first and second substrates facing each other. Electron emission regions are positioned on the first substrate, and an anode electrode and phosphor layers are positioned on the second substrate such that the electrons emitted from the electron emission regions collide with the phosphor layers, thereby emitting light. The anode electrode receives positive (+) voltages ranging from several hundred to several thousand volts and directs the electrons emitted from the electron emission regions toward the phosphor layers.

A focusing or grid electrode is sometimes positioned between the first and second substrates. The focusing or grid electrode increases the focusing capacity of the electron beams emitted from the electron emission regions. As the thickness of the focusing electrode increases, its electron beam focusing capacity and its ability to intercept the anode electric field before the electric field reaches the electron emission regions are enhanced.

Currently available focusing electrode film formation techniques, like sputtering, cannot form focusing electrodes with thicknesses of 1 μm or more. Therefore, metallic mesh-shaped grid electrodes having a plurality of beam guide holes in a predetermined pattern have been used instead of focusing electrodes. However, it is difficult to form small beam guide holes on the metal plate, and to correctly locate the grid electrode between the first and second substrates.

SUMMARY OF THE INVENTION

In one exemplary embodiment of the present invention, there is provided an electron emission device having a focusing electrode with a thickness large enough to improve the ability of the focusing electrode to focus the electron beams and to intercept the anode electric field before the electric field reaches the electron emission regions.

In one embodiment, the electron emission device includes first and second substrates facing each other. First and second electrodes are positioned on the first substrate and are insulated from each other. Electron emission regions are electrically connected to at least one of the first and second electrodes. An insulating layer is positioned over the first and second electrodes, and a focusing electrode is positioned on the insulating layer. The focusing electrode includes openings to allow passage of the electron beams. The focusing electrode comprises a first layer having a first thickness, and second and third layers surrounding the first layer and having second and third thicknesses each less than the first thickness. The first thickness ranges from about 5 to about 100 μm, and each of the second and third thicknesses ranges from about 0.1 to about 1.0 μm.

The second layer of the focusing electrode is positioned on the insulating layer, and the third layer covers the top surface and sides of the first layer, including the sides of the first layer lying within the openings. The third layer is electrically connected to the second layer.

An insulating layer is disposed between the first and second electrodes. The first electrodes are positioned on the first substrate. The insulating layer is positioned on the first electrodes, and the second electrodes are positioned on the insulating layer such that they extend substantially perpendicular to the first electrodes. The electron emission regions are positioned at the points where the first electrodes intersect the second electrodes.

In an alternative embodiment, the first and second electrodes are arranged on the first substrate such that they extend substantially parallel to each other. In this embodiment, a first conductive layer is positioned on the first substrate such that it partially covers the first electrode, and a second conductive layer is positioned on the first substrate such that it partially covers the second electrode. The first and second conductive layers are positioned close to each other but do not meet. The electron emission regions are disposed on the first substrate between the first and second conductive layers.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF THE INVENTION

Figure 1:
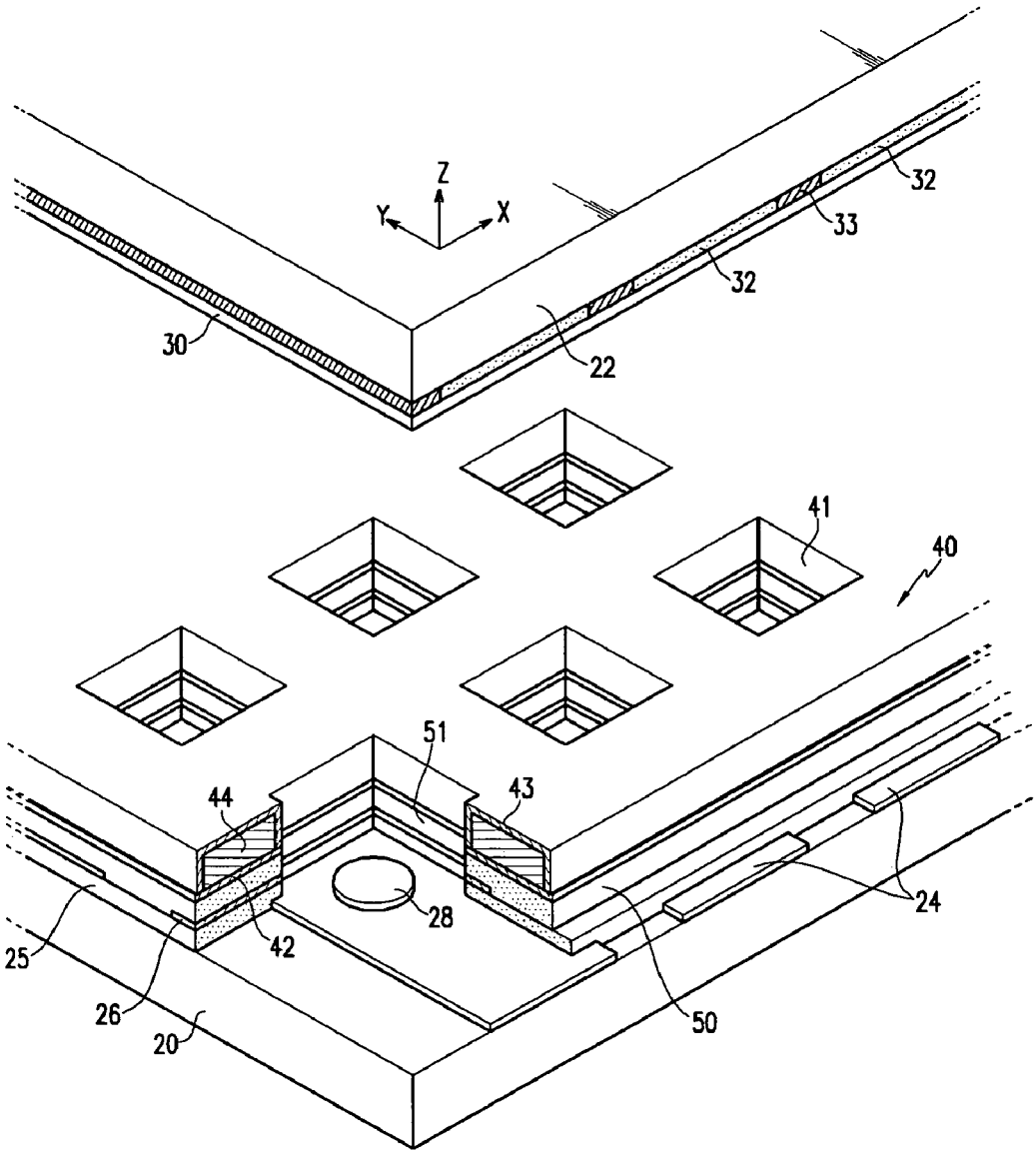
FIG. 1 is an amplified partially cut-away perspective view of an electron emission device according to one embodiment of the present invention.
Figure 2:
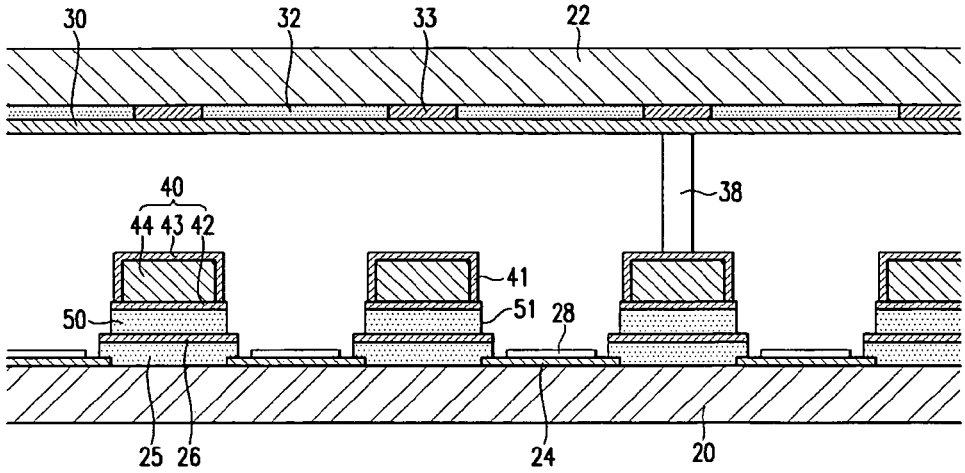
FIG. 2 is an amplified partial cross-sectional view of an electron emission device according to one embodiment of the present invention.
Figure 3:
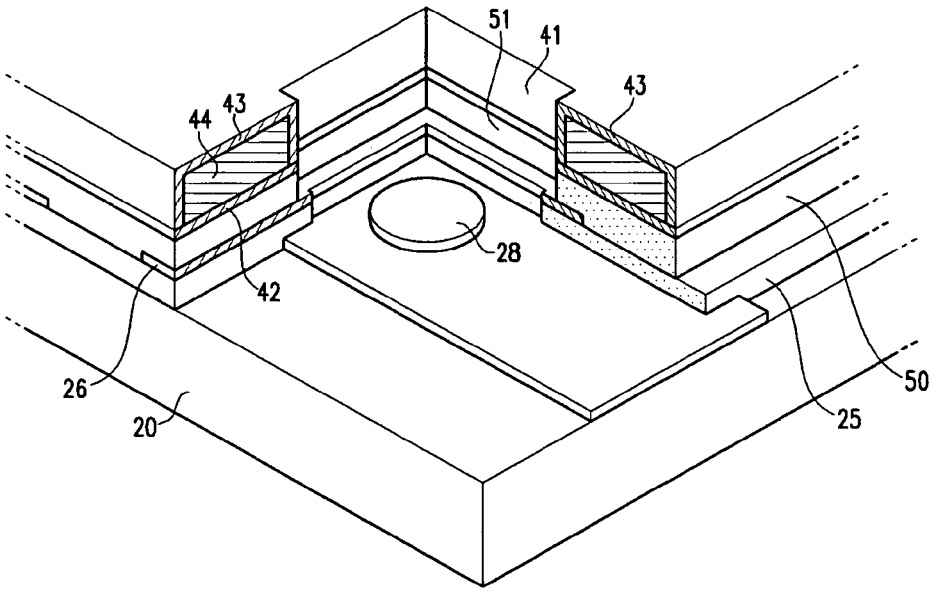
FIG. 3 is an amplified partially cut-away perspective view, showing a focusing electrode, of an electron emission device according to one embodiment of the present invention.
Figure 4:
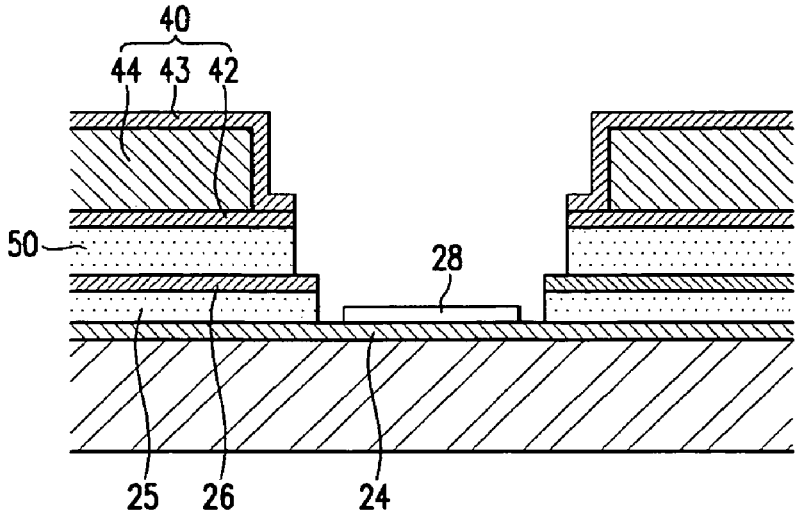
FIG. 4 is an amplified partial cross-sectional view, showing a focusing electrode, of an electron emission device according to one embodiment of the present invention.

The present invention will be described more fully hereinafter with reference to the accompanying drawings, in which preferred embodiments of the invention are shown.

As shown in FIGS. 1 to 4, the electron emission device comprises a first substrate 20 and a second substrate 22 arranged facing each other and separated from each other by a predetermined distance, forming an inner space. An electron emission structure for emitting electrons is positioned on the first substrate 20, and a light emission or display structure for emitting visible rays and displaying desired images is positioned on the second substrate 22.

Specifically, first electrodes (cathode electrodes) 24 are positioned on the first substrate 20, and a first insulating layer 25 is positioned over the first electrodes 24. Second electrodes 26 (gate electrodes) are positioned on the first insulating layer 25 such that they extend substantially perpendicular to the first electrodes 24. Electron emission regions 28 are positioned on the first electrodes 24 at the points where the second electrodes 26 intersect the first electrodes 24, and a second insulating layer 50 is positioned over the second electrodes 26. A focusing electrode 40 is positioned on the second insulating layer 50.

The focusing electrode 40 comprises a first layer 44 having a first thickness of several micrometers, a second layer 42 and a third layer 43, having second and third thicknesses each less than the first thickness. The second layer 42 and the third layer 43 surround the first layer 44. The focusing electrode 40 comprises openings 41 positioned in a predetermined pattern to allow passage of electron beams emitted from the electron emission regions 28.

The focusing electrode 40 increases the ability to focus the electron beams emitted from the electron emission regions 28. The second insulating layer 50 disposed between the focusing electrode 40 and the second electrodes 26 electrically insulates the focusing electrode 40 from the second electrodes 26. The second insulating layer 50 also comprises openings 51 corresponding to the location of the electron emission regions 28.

The second layer 42 of the focusing electrode 40 is positioned on the second insulating layer 50, and the third layer 43 covers the top surface and sides of the first layer 44, including the sides of the first layer 44 lying within the openings 41. The focusing electrode 40 is fabricated by first positioning the second layer 42 on the second insulating layer 50. The first layer 44 is then positioned on the second layer 42, and the third layer 43 is then positioned on the top surface and sides of the first layer 44.

The first layer 44 is fabricated by screen-printing a non-conductive material, such as polyimide, on the second layer 42. The first layer 44 has a first thickness of several micrometers, preferably of about 5 to about 100 μm.

The third layer 43 is fabricated by coating a metal-like conductive material on the top surface and sides of the first layer 44 by deposition or sputtering. The third layer 43 contacts and is electrically connected to the second layer 42. The second layer 42 and the third layer 43 have second and third thicknesses of several micrometers or less, preferably of about 0.1 to about 1 μm, and are patterned such that they do not short-circuit the electron emission regions 28.

As described above, the focusing electrode 40 has a first layer 44 with a first thickness of several micrometers. The second layer 42 and third layer 43 provide conduction characteristics for focusing the electron beams. The focusing electrode has several openings 41 and is positioned in the path of the electron beams, thereby enhancing the ability to focus the electron beams and to intercept the anode electric field before the electric field reaches the electron emission regions.

In this embodiment, the electron emission regions 28 comprise a material capable of emitting electrons when an electric field is applied to them in a vacuum atmosphere. For example, the electron emission regions 28 may comprise carbonaceous materials or nanometer-sized materials. Nonlimiting examples of suitable materials for the electron emission regions 28 include carbon nanotube, graphite, graphite nanofiber, diamond, diamond-like carbon, $C_{60}$, silicon nanowire, and combinations thereof. The electron emission regions 28 may be fabricated by screen printing, chemical vapor deposition, direct growth, or sputtering. The electron emission regions 28 may have various shapes, such as cones, wedges, or thin edged films.

An anode electrode 30 and phosphor layers 32 are formed on the surface of the second substrate 22 facing the first substrate 20. The anode electrode 30 receives positive voltages of several tens to several thousand volts from an outside source, and directs the electrons emitted from the first substrate 20 toward the phosphor layers 32.

In this embodiment, the phosphor layers 32 comprise red, green or blue layers. A black layer 33 is positioned between the respective phosphor layers 32 to enhance screen contrast. The anode electrode 30 is positioned on the phosphor layers 32 and the black layer 33 and comprises a metal-based layer, for example an aluminum-based layer. The anode electrode 30 creates a metal back effect, thereby increasing screen brightness.

The anode electrode 30 may comprise a transparent conductive layer, such as indium tin oxide, instead of a metallic layer. In this embodiment, the anode electrode (not shown) is first positioned on the second substrate 22. The phosphor layers 32 and the black layer 33 are then positioned on the anode electrode. When needed, a metallic layer, for example an aluminum-based layer, may be positioned on the phosphor layers 32 and the black layer 33 to increase screen brightness. A single anode electrode may be positioned on the entire surface of the second substrate 22, or a plurality of anode electrodes may be positioned thereon in a predetermined pattern.

The above-described first and second substrates 20 and 22, respectively, are arranged such that the focusing electrode 40 faces the anode electrode 30 and is spaced apart from the anode electrode 30 by a predetermined distance. The first and second substrates 20 and 22, respectively, are attached to each other by a suitable sealing material, such as frit. The air in the inner space between the substrates is evacuated to create a vacuum, resulting in the creation of an electron emission device. A plurality of spacers 38 are arranged at the non-light emitting areas between the first and second substrates 20 and 22, respectively, to maintain a constant distance between the two substrates.

The electron emission device is driven by feeding predetermined voltages to the first electrodes 24, the second electrodes 26, the focusing electrode 40 and the anode electrode 30 from an outside source. The application of voltages to the respective electrodes creates a difference in potential between the first and second electrodes 20 and 22, respectively, which generates an electric field around the electron emission regions. When such an electric field is generated, the electron emission regions emit electrons. The emitted electrons are then directed toward the second substrate 22 and focused by the negative (−) voltage of the focusing electrode 40. The focused electrons are then attracted by the high voltage applied to the anode electrode 30, and collide against the phosphor layers 32 at the relevant pixels, thereby emitting light.

Figure 5:
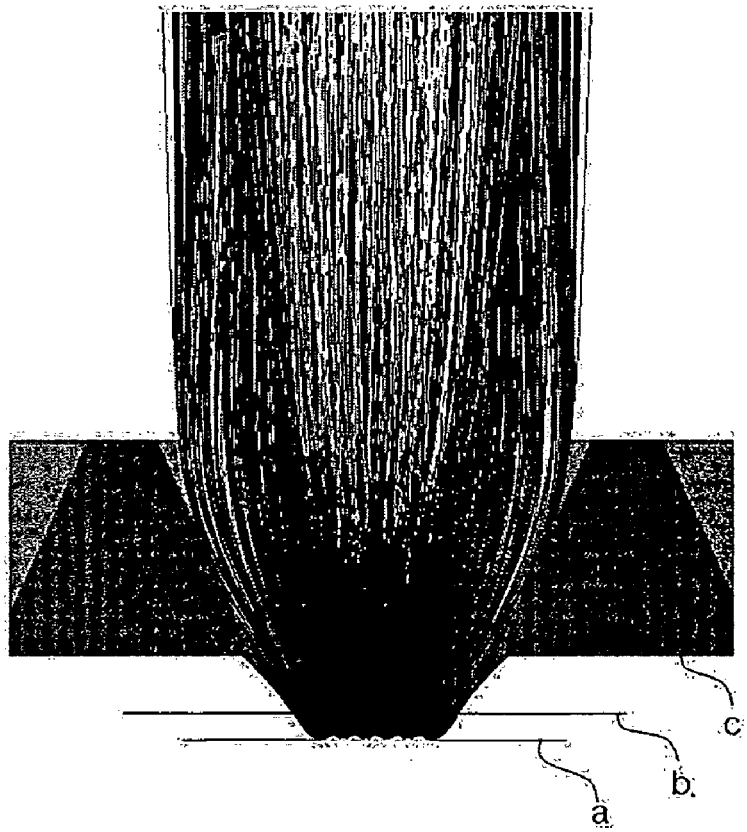
FIG. 5 is a partial cross-sectional view of an electron emission device according to one embodiment of the present invention, illustrating the electron beam emission trajectory.
Figure 6:
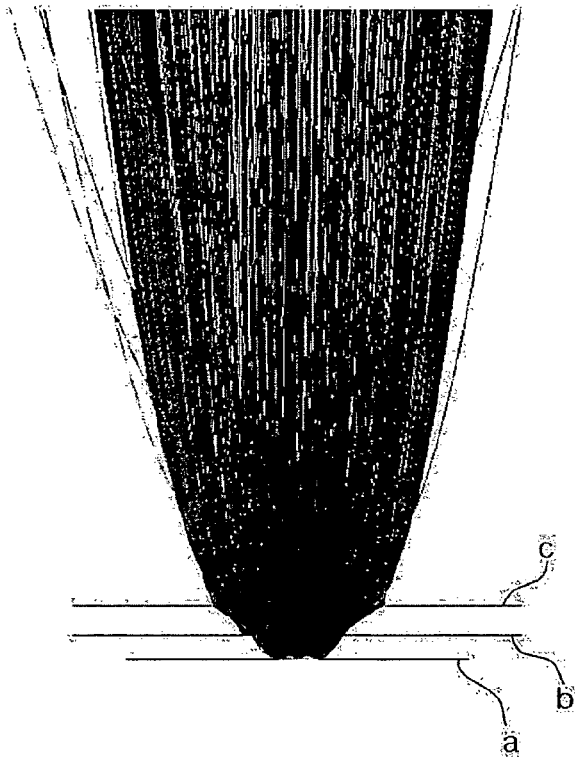
FIG. 6 is a partial cross-sectional view of an electron emission device according to the prior art, illustrating the electron beam emission trajectory.

FIG. 5 is a partial cross-sectional view illustrating the electron beam emission trajectory of an electron emission device having a focusing electrode with a thickness of about 100 μm. FIG. 6 is a partial cross-sectional view illustrating the electron beam emission trajectory of a prior art electron emission device having a focusing electrode with a thickness of about 0.2 μm. In FIGS. 5 and 6, a is the location of the first electrode, b is the location of the second electrode, and c is the location of the focusing electrode.

The electron beam emission trajectory illustrated in FIG. 5 was measured while applying 0V to the first electrode, 100V to the second electrode, 70V to the focusing electrode, and 1500V to the anode electrode. As shown in FIG. 5, the electron beams proceed straight toward the anode electrode. This trajectory is greatly influenced by the focusing force imparted by the thickness of the focusing electrode.

The electron beam emission trajectory illustrated in FIG. 6 was measured while applying 0V to the first electrode, 100V to the second electrode, 0V to the focusing electrode, and 1500V to the anode electrode. The thickness of the focusing electrode in the electron emission device according to the prior art is substantially less than that of the focusing electrode according to the present invention. As shown in FIG. 6, the electron beams passing through the focusing electrode according to the prior art are not significantly influenced by the focusing electrode. Consequently, the electron beams do not proceed straight toward the anode electrode. Rather, the beams proceed at an angle.

Figure 7:
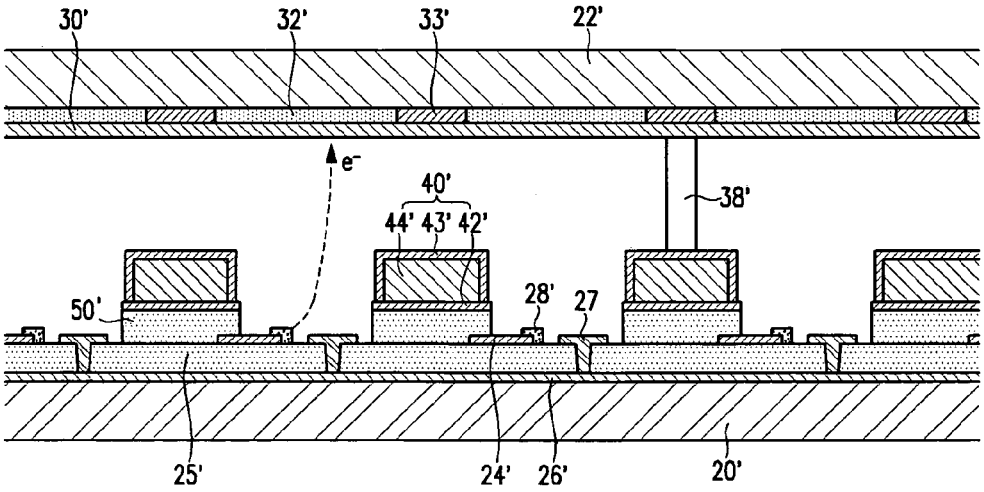
FIG. 7 is an amplified partial cross-sectional view of an electron emission device according to another embodiment of the present invention.

In the above embodiment, the second electrodes (gate electrodes) 26 are positioned on the first electrodes (cathode electrodes) 24. Alternatively, however, in an alternative electron emission device as shown in FIG. 7, second electrodes 26' are positioned beneath first electrodes 24'. In this embodiment, a second insulating layer 50' is positioned on the first electrodes 24' and a focusing electrode 40' is positioned on the second insulating layer 50'. A counter electrode 27 is positioned between neighboring first electrodes 24' and is spaced apart from the electron emission regions 28' by a predetermined distance. The counter electrode 27 directs the electric field from the second electrode 26' to the top of the first insulating layer 25'.

Figure 8:
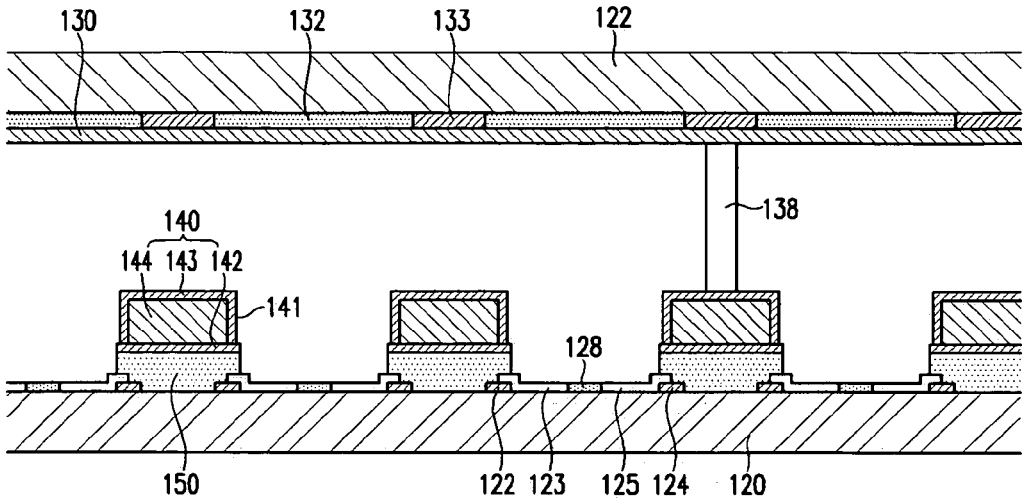
FIG. 8 is an amplified partial cross-sectional view of an electron emission device according to still another embodiment of the present invention.
Figure 9:
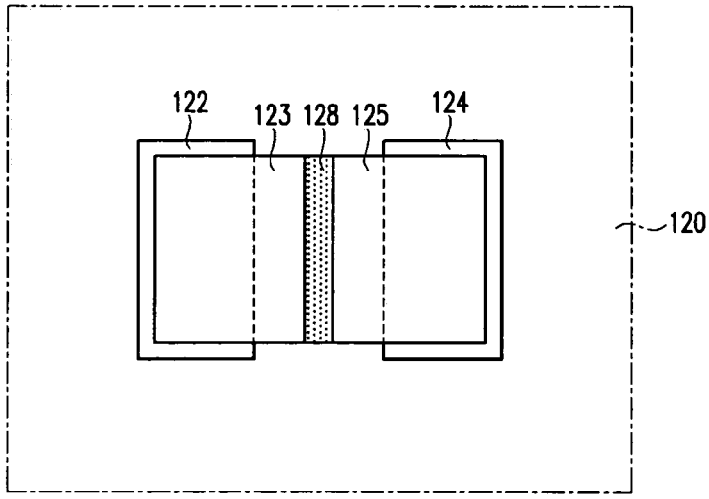
FIG. 9 is an amplified partial plan view of the electron emission device according to the embodiment of FIG. 8.

As shown in FIGS. 8 and 9, an alternative electron emission device includes first and second electrodes 122 and 124, respectively, positioned on a first substrate 120, and separated from each other by a predetermined distance. Electron emission regions 128 are electrically connected to the first and second electrodes 122 and 124 respectively, and are disposed between the first and second electrodes 122 and 124, respectively. An insulating layer 150 is disposed over the first and second electrodes 122 and 124, respectively, and a focusing electrode 140 is positioned on the insulating layer 150. Phosphor layers 132 and an anode electrode 130 are positioned on a second substrate 122. The focusing electrode 140 comprises openings 141 positioned in a predetermined pattern to allow passage of electron beams.

The first and second electrodes 122 and 124, respectively, are arranged on the first substrate 120 parallel to each other. A first conductive layer 123 partially covers the first electrodes 122 and a second conductive layer 125 partially covers the second electrodes 124. The first and second conductive layers 123 and 125, respectively, are positioned close to each other but are separated from each other by a nanometer-sized gap. The electron emission regions 128 are positioned between the first and second conductive layers 123 and 125, respectively. The first and second electrodes 122 and 124, respectively, are separated from each other by a distance of several tens to several hundred nanometers. The electron emission regions 128 have high resistance values.

The first and second electrodes 122 and 124, respectively, may comprise an electrically conductive material. Nonlimiting examples of materials suitable for use as the first and second electrodes 122 and 124, respectively, include nickel (Ni), chromium (Cr), gold (Au), molybdenum (Mo), tungsten (W), platinum (Pt), titanium (Ti), aluminum (Al), copper (Cu), palladium (Pd), silver (Ag), alloys thereof, printed conductor based or metallic oxides thereof, and indium tin oxide (ITO)-based transparent electrodes. The first and second conductive layers 123 and 125, respectively, comprise a thin particulate film comprising a conductive material. Nonlimiting examples of materials suitable for use as the first and second conductive layers 123 and 125, respectively, include nickel (Ni), gold (Au), platinum (Pt) and palladium (Pd).

The focusing electrode 140 has a first layer 144 having a first thickness, a second layer 142 and a third layer 143. The second layer 142 and third layer 143 have second and third thicknesses each less than the first thickness. The second layer 142 is positioned beneath the first layer 144, and the third layer 143 surrounds the first layer 144. The second layer 142 is positioned on the insulating layer 150, and the third layer 143 covers the top surface and sides of the first layer 144, including the sides of the first layer 144 lying within the openings 141. The first layer 144 has a first thickness of several micrometers, preferably of about 5 to about 100 μm. The second and third layers 142 and 143, respectively, have second and third thicknesses, each less than the first thickness, of about 0.1 to about 1.0 μm.

When predetermined voltages are applied to the first and second electrodes 122 and 124, respectively, an electric current is directed to the electron emission regions 128 disposed between the first and second electrodes 122 and 124, respectively. A high voltage is then applied to the anode electrode 130, and electrons are emitted. The electrons pass through the openings 141 of the focusing electrode 140 and are focused by the negative (−) voltages (several tens of volts) applied to the focusing electrode 140. The electrons then collide with the phosphor layers 132, thereby emitting light.

The inventive structure is particularly useful in FEA- or SCE-type electron emission devices. However, the inventive device is also useful in other electron emission devices.

As described above, the focusing electrode has a thickness great enough to intercept the anode electric field without using a grid electrode, and great enough to increase the electron beam focusing capacity. The increased ability to intercept the anode electric field and the increased electron focusing capacity enhance the color representation of the screen.

Although preferred embodiments of the present invention have been described in detail hereinabove, it should be clearly understood that many variations and/or modifications of the basic inventive concept herein taught will appear to those skilled in the art and fall within the spirit and scope of the present invention, as defined in the appended claims.

What is claimed is:

1. An electron emission device comprising:

first and second substrates, each facing each other and separated from each other by a distance;

a plurality of first electrodes positioned on the first substrate;

a plurality of second electrodes positioned on the first substrate, the first and second electrodes being electrically insulated from each other;

a plurality of electron emission regions electrically connected to at least one of the first and second electrodes;

an insulating layer positioned on the second electrodes; and a focusing electrode positioned on the insulating layer, the focusing electrode having a plurality of openings to allow passage of electron beams, wherein the focusing electrode comprises a first layer having a first thickness, a second layer beneath the first layer, and a third layer surrounding the first layer, wherein the second and third layers have second and third thicknesses, the second and third thicknesses each being less than the first thickness.

2. The electron emission device of claim 1, wherein the first thickness ranges from about 5 to about 100 μm.

3. The electron emission device of claim 1, wherein the first layer of the focusing electrode comprises polyimide.

4. The electron emission device of claim 1, wherein each of the second and third thicknesses ranges from about 0.1 to about 1.0 μm.

5. The electron emission device of claim 1, wherein the second layer of the focusing electrode is positioned on the insulating layer, and the third layer covers the top surface and sides of the first layer including the sides of the first layer lying within the openings, the third layer being electrically connected to the second layer.

6. The electron emission device of claim 1, further comprising an electrode insulating layer positioned on the first substrate between the first and second electrodes, wherein the second electrodes extend substantially perpendicular to the first electrodes, and the electron emission regions are positioned at the points of intersection of the first electrodes and second electrodes.

7. The electron emission device of claim 1, wherein the electron emission regions comprise a material selected from the group consisting of carbon nanotube, graphite, graphite nanofiber, diamond, diamond-like carbon, $C_{60}$, silicon nanowire, and mixtures thereof.

8. The electron emission device of claim 1, wherein the first and second electrodes extend parallel to each other, the electron emission device further comprising:

a first conductive layer positioned on the first substrate partially covering the first electrodes; and a second conductive layer positioned on the first substrate partially covering the second electrodes, wherein the first and second conductive layers are separated by a distance and the electron emission regions are positioned on the first substrate between the first and second conductive layers.

9. The electron emission device of claim 8, wherein the first and second electrodes comprise a material selected from the group consisting of Ni, Cr, Au, Mo, W, Pt, Ti, Al, Cu, Pd, Ag, alloys thereof, printed conductor based oxides thereof, metallic oxides thereof and indium tin oxide-based transparent electrodes.

10. The electron emission device of claim 8, wherein the first and second conductive layers comprise a material selected from the group consisting of Ni, Au, Pt and Pd.

11. The electron emission device of claim 1, further comprising:

at least one anode electrode positioned on the second substrate; and a plurality of phosphor layers positioned on a surface of the anode electrode.

12. An electron emission device comprising:

first and second substrates, each facing each other and separated from each other by a distance;

a plurality of first electrodes positioned on the first substrate;

a plurality of second electrodes positioned on the first substrate, the first and second electrodes being electrically insulated from each other;

a plurality of electron emission regions electrically connected to at least one of the first and second electrodes;

an insulating layer positioned on the second electrodes; and a focusing electrode positioned on the insulating layer, the focusing electrode having a plurality of openings to allow passage of electron beams, wherein the focusing electrode comprises a first layer having a first thickness of about 5 to about 100 μm, a second layer beneath the first layer, and a third layer surrounding the first layer, wherein the second and third layers have second and third thicknesses, each of the second and third thicknesses independently ranging from about 0.1 to about 1.0 μm.

13. An electron emission device comprising:

first and second substrates, each facing each other and separated from each other by a distance;

a plurality of first electrodes positioned on the first substrate;

a first insulating layer positioned on the first substrate covering the first electrodes;

a plurality of second electrodes positioned on the first insulating layer, wherein the second electrodes extend substantially perpendicular to the first electrodes;

a plurality of electron emission regions electrically connected to at least one of the first and second electrodes;

a second insulating layer positioned on the second electrodes; and a focusing electrode positioned on the second insulating layer, the focusing electrode having a plurality of openings to allow passage of electron beams, wherein the focusing electrode comprises a first layer having a first thickness, a second layer beneath the first layer, and a third layer surrounding the first layer, wherein the second and third layers have second and third thicknesses, the second and third thicknesses each being less than the first thickness.

14. The electron emission device of claim 13, wherein the first thickness ranges from about 5 to about 100 μm.

15. The electron emission device of claim 13, wherein the first layer of the focusing electrode comprises polyimide.

16. The electron emission device of claim 13, wherein each of the second and third thicknesses ranges from about 0.1 to about 1.0 μm.

17. The electron emission device of claim 13, wherein the second layer of the focusing electrode is positioned on the second insulating layer, and the third layer covers the top surface and sides of the first layer including the sides of the first layer lying within the openings, the third layer being electrically connected to the second layer.

18. The electron emission device of claim 13, wherein the electron emission regions are positioned at the points of intersection of the first electrodes and second electrodes.

19. An electron emission device comprising:

first and second substrates, each facing each other and separated from each other by a distance;

a plurality of first electrodes positioned on the first substrate;

a plurality of second electrodes positioned on the first substrate, wherein the second electrodes extend substantially parallel to the first electrodes;

a plurality of electron emission regions electrically connected to at least one of the first and second electrodes;

a first conductive layer positioned on the first substrate partially covering the first electrodes;

a second conductive layer positioned on the first substrate partially covering the second electrodes, wherein the first and second conductive layers are separated by a distance and the electron emission regions are positioned on the first substrate between the first and second conductive layers;

an insulating layer positioned on the second electrodes; and a focusing electrode positioned on the insulating layer, the focusing electrode having a plurality of openings to allow passage of electron beams, wherein the focusing electrode comprises a first layer having a first thickness, a second layer beneath the first layer, and a third layer surrounding the first layer, wherein the second and third layers have second and third thicknesses, the second and third thicknesses each being less than the first thickness.

20. The electron emission device of claim 19, wherein the first thickness ranges from about 5 to about 100 μm.

21. The electron emission device of claim 19, wherein the first layer of the focusing electrode comprises polyimide.

22. The electron emission device of claim 19, wherein each of the second and third thicknesses ranges from about 0.1 to about 1.0 μm.

23. The electron emission device of claim 19, wherein the second layer of the focusing electrode is positioned on the insulating layer, and the third layer covers the top surface and sides of the first layer including the sides of the first layer lying within the openings, the third layer being electrically connected to the second layer.

24. The electron emission device of claim 19, wherein the electron emission regions comprise a material selected from the group consisting of carbon nanotube, graphite, graphite nanofiber, diamond, diamond-like carbon, $C_{60}$, silicon nanowire, and mixtures thereof.

* * * * *